US008135156B2

(12) United States Patent
Hu

(10) Patent No.: US 8,135,156 B2
(45) Date of Patent: Mar. 13, 2012

(54) SOUND REPRODUCTION DEVICE WITH ENHANCED LOW-FREQUENCY SOUND EFFECT

(76) Inventor: Ken-Pei Hu, Taipei (TW)

( * ) Notice: Subject to any disclaimer, the term of this patent is extended or adjusted under 35 U.S.C. 154(b) by 287 days.

(21) Appl. No.: 12/588,636

(22) Filed: Oct. 22, 2009

(65) Prior Publication Data

US 2011/0096949 A1 Apr. 28, 2011

(51) Int. Cl.
*H04R 1/20* (2006.01)

(52) U.S. Cl. ..... 381/352; 381/345

(58) Field of Classification Search ..... 381/335, 381/337, 338, 345, 351, 352, 354; 181/148, 181/153, 155
See application file for complete search history.

(56) References Cited

U.S. PATENT DOCUMENTS 5,892,184 A * 4/1999 D'Hoogh ..... 181/156
6,626,263 B2 * 9/2003 Sahyoun ..... 381/349
2004/0252859 A1 * 12/2004 Saiki ..... 381/345

* cited by examiner

*Primary Examiner* — Brian Ensey
(74) *Attorney, Agent, or Firm* — Bacon & Thomas, PLLC

(57) ABSTRACT

This invention is to provide a sound reproduction device including a tube, a loudspeaker and a resonance unit, wherein the loudspeaker includes a frame body having a side adjacent to a first diaphragm thereof peripherally fixed to a first opening of the tube, and the resonance unit includes a second diaphragm peripherally fixed to a second opening of the tube and a weighting element fixed at a central position of the second diaphragm. Thus, a closed resonance chamber is defined within the tube between the loudspeaker and resonance unit. When the loudspeaker is driven, the first diaphragm is vibrated and in turn vibrates air in front of the sound reproduction device to make sound and drives the second diaphragm to vibrate air behind the sound reproduction device synchronously in the same direction, thereby producing twice as strong low-frequency sound effect as a traditional sound reproduction device without a resonance unit.

3 Claims, 6 Drawing Sheets

SOUND REPRODUCTION DEVICE WITH ENHANCED LOW-FREQUENCY SOUND EFFECT

FIELD OF THE INVENTION

The present invention relates to a sound reproduction device, more particularly to a sound reproduction device with enhanced low-frequency sound effect, which includes a loudspeaker and a resonance unit. When a diaphragm of the loudspeaker is vibrated, which in turn vibrates air in front of the sound reproduction device so as to make sound and drives the resonance unit to vibrate air behind the sound reproduction device synchronously in the same direction, thereby producing twice as strong low-frequency sound effect as a traditional sound reproduction device without a resonance unit.

BACKGROUND OF THE INVENTION

Recently, with rapid advancement of technology, electronic products such as portable loudspeakers, cell phones, mobile television sets, and voice navigation devices are equipped with a diversity of functions and made increasingly compact, thus allowing users to not only carry these electronic products around conveniently, but also enjoy their various functions anytime and anywhere.

Each of the above-cited electronic products is generally provided with at least one loudspeaker for reproducing music, voice, and/or other sounds, and it is well known that loudness of a loudspeaker depends, for an important part, on its physical size. However, as stated above, with compactness being the mainstream design concept for electronic products nowadays, loudspeakers used in such electronic products tend to be small and thus only produce low acoustic volume, particularly of the low-frequency range. In consequence, when electronic products of this kind are used to reproduce sound, it is unlikely for the user to hear the sound loud and clear, nor fully appreciate the low-frequency sound effect of the loudspeakers. Therefore, under the current trend in electronic product design, it is a pressing problem for loudspeaker manufacturers to balance between the dimension and the quality and volume of sound of a loudspeaker, with a view to offering optimal sound reproduction effect to consumers.

As a solution to the aforesaid problem, a sound reproduction device as shown in FIG. 1 was designed. Referring to FIG. 1, a sound reproduction device 1 includes a housing 10, a first loudspeaker 11, and a second loudspeaker 12. The housing 10 has an end formed with an opening. The housing 10 is also provided therein with an accommodating space. The first loudspeaker 11 includes a first frame body 110 having an end peripherally fixed to the housing 10 around a rim of the opening. Thus, the first frame body 110, along with a diaphragm, a coil, and a magnetic element provided in the first frame body 110, is received in the accommodating space. On the other hand, the second loudspeaker 12 includes a second frame body 120 having an end peripherally fixed to an inner periphery of the housing 10 between the first loudspeaker 11 and an opposite end of the housing 10. By means of the first loudspeaker 11 and the second loudspeaker 12, a closed resonance chamber 13 is defined in the accommodating space of the housing 10 as between the first loudspeaker 11 and the second loudspeaker 12, and a closed reflection chamber 14 is defined in the accommodating space of the housing 10 as between the second loudspeaker 12 and the opposite end of the housing 10.

The coil in each of the first and second loudspeakers 11, 12 is centrally provided at an inner periphery of the corresponding diaphragm. When a current flows through the coils in the first and second loudspeakers 11, 12, respectively, the coils are excited to generate field lines. Attraction and repulsion between the coils and field lines generated by the corresponding magnetic elements in the loudspeakers 11, 12 drive the diaphragms of the loudspeakers 11, 12 to vibrate synchronously. In consequence, air in the resonance chamber 13 and in front of the sound reproduction device 1 is vibrated to make sound. Now that the first loudspeaker 11 and the second loudspeaker 12 are connected by the closed resonance chamber 13, vibration of the diaphragms produces a compression effect as well as a vacuum effect on the air in the resonance chamber 13. In turn, the air in the resonance chamber 13 drives the diaphragms of the loudspeakers 11, 12 to vibrate even more vigorously, thereby increasing the loudness of sound reproduced. Meanwhile, air in the reflection chamber 14 is vibrated in the same direction and reflected by the opposite end of the housing 10 so as to cause secondary resonance. With the synchronous vibration and the secondary resonance in front of and behind the sound reproduction device 1, the sound reproduction device 1 produces a more significant low-frequency sound effect than a traditional loudspeaker.

However, the sound reproduction device 1 still has its shortcomings in use, as detailed below:

1. For the sound reproduction device 1 to reproduce sound, it is necessary that both the loudspeakers 11, 12 are driven. Therefore, the sound reproduction device 1, though capable of making sound at larger volume and producing more significant low-frequency sound effect than a traditional loudspeaker, consumes twice as much power, too. In other words, the sound reproduction device 1 works against the concept of energy saving and environmental protection that the entire world today endeavors to live up to.

2. While the sound reproduction device 1 is in operation, the loudspeakers 11, 12 must sound synchronously so as for the sound reproduction device 1 to make sound properly, without noise or audio signal interference. Hence, it is imperative that the specifications, circuits, and installation locations of the loudspeakers 11, 12 be strictly planned and designed; otherwise, the loudspeakers 11, 12 in the sound reproduction device 1 may not sound synchronously. Therefore, the sound reproduction device 1 incurs considerable costs of design and quality control during the design and production processes, which makes it impossible to effectively reduce the selling price of the sound reproduction device 1. And because of that, market competitiveness of the sound reproduction device 1 may be seriously impaired.

3. In addition, since the sound reproduction device 1 requires two loudspeakers, material costs of the sound reproduction device 1 are lofty. This also contributes to the high selling price and low market competitiveness of the sound reproduction device 1.

Hence, it is an important goal of the present invention to design a sound reproduction device which, under the premise of providing high sound volume and enhanced low-frequency sound effect, is capable of effectively lowering the costs of production, quality control, design, and materials, as well as working in accordance with the concept of energy saving and environmental protection, thereby solving the aforementioned problems of the traditional loudspeakers or sound reproduction devices.

BRIEF SUMMARY OF THE INVENTION

The inventor of the present invention put years of practical experience into relevant research and experiments and finally accomplished a sound reproduction device as disclosed herein. It is hoped that, with the present invention, the concept of energy saving and environmental protection can be realized, the sound reproduced is loud and clear with superior low-frequency sound effect, and manufacturers are enabled to make high-quality and competitive sound reproduction devices at low costs.

It is an objective of the present invention to provide a sound reproduction device with enhanced low-frequency sound effect, wherein the sound reproduction device includes a tube, a loudspeaker, and a resonance unit. The loudspeaker includes a frame body, wherein the frame body has a side which is adjacent to a first diaphragm and peripherally fixed to a first opening at an end of the tube. The resonance unit is composed of a second diaphragm and a weighting element, wherein the second diaphragm is peripherally fixed to a second opening at an opposite end of the tube. Thus, the first opening and the second opening at the two ends of the tube are respectively sealed, and a closed resonance chamber is defined in an accommodating space of the tube as between the loudspeaker and the resonance unit. The weighting element is fixed at a central position of the second diaphragm. When the loudspeaker is driven, the first diaphragm is vibrated and in turn vibrates air in front of the sound reproduction device so as to make sound. Meanwhile, vibration of the first diaphragm produces a compression/vacuum effect on air inside the resonance chamber and thereby drives the second diaphragm of the resonance unit to vibrate almost synchronously. The second diaphragm also drives air behind the sound reproduction device to vibrate in the same direction. Hence, air in front of and behind the sound reproduction device is vibrated almost synchronously in the same direction, thereby producing twice as strong low-frequency sound effect as a traditional sound reproduction device without a resonance unit. In addition, since the sound reproduction device of the present invention uses only one loudspeaker, power consumption is effectively lowered. Therefore, not only is the goal of energy saving and environmental protection achieved, but also the costs of designing and manufacturing the sound reproduction device of the present invention can be reduced significantly.

BRIEF DESCRIPTION OF THE SEVERAL VIEWS OF THE DRAWINGS

The invention as well as a preferred mode of use, further objectives, and advantages thereof will be best understood by referring to the following detailed description of illustrative embodiments in conjunction with the accompanying drawings, wherein.

DETAILED DESCRIPTION OF THE INVENTION

Figure 1:
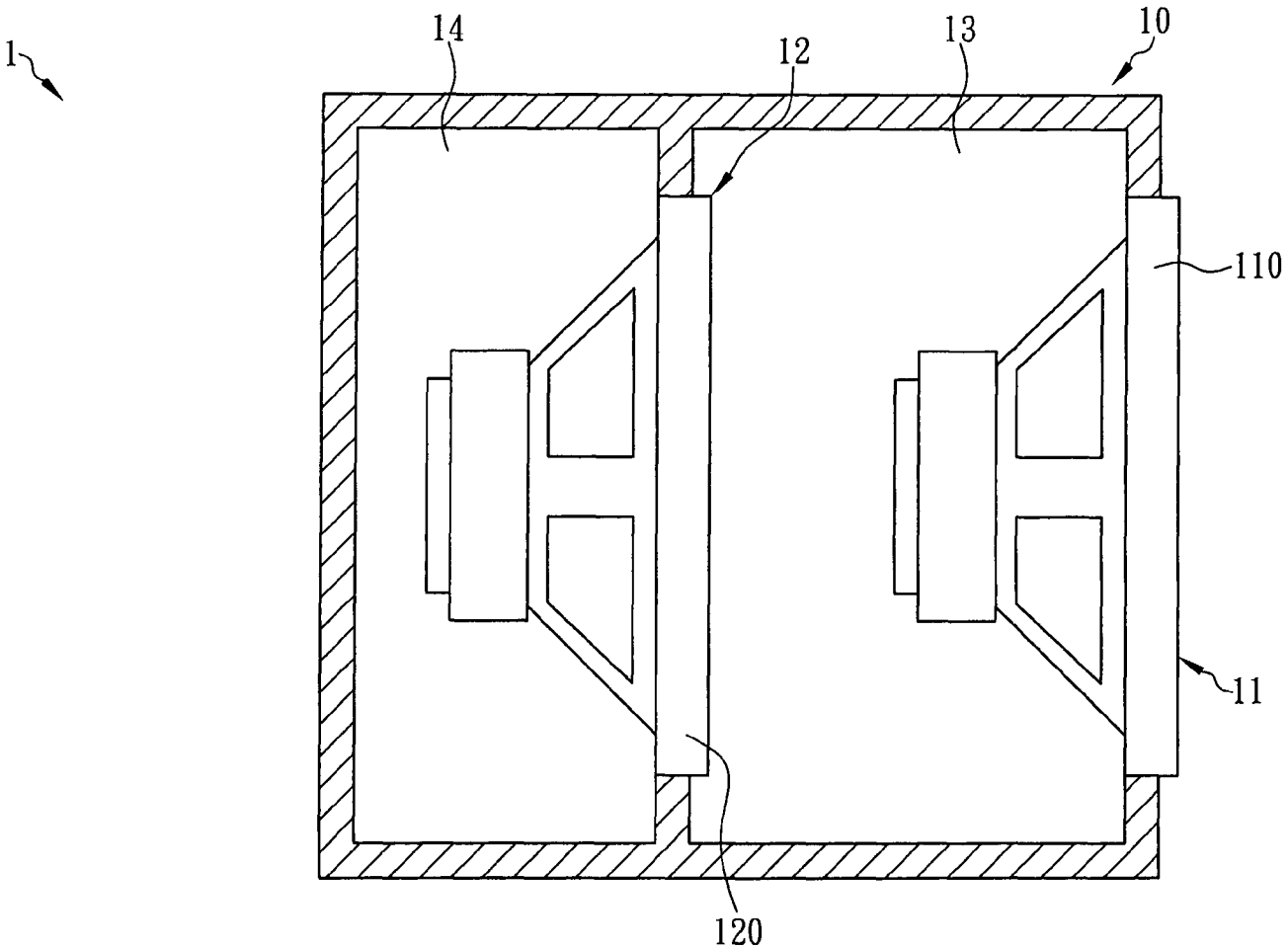
FIG. 1 (Prior Art)
FIG. 1 is a schematic view of a traditional sound reproduction device.
Figure 2:
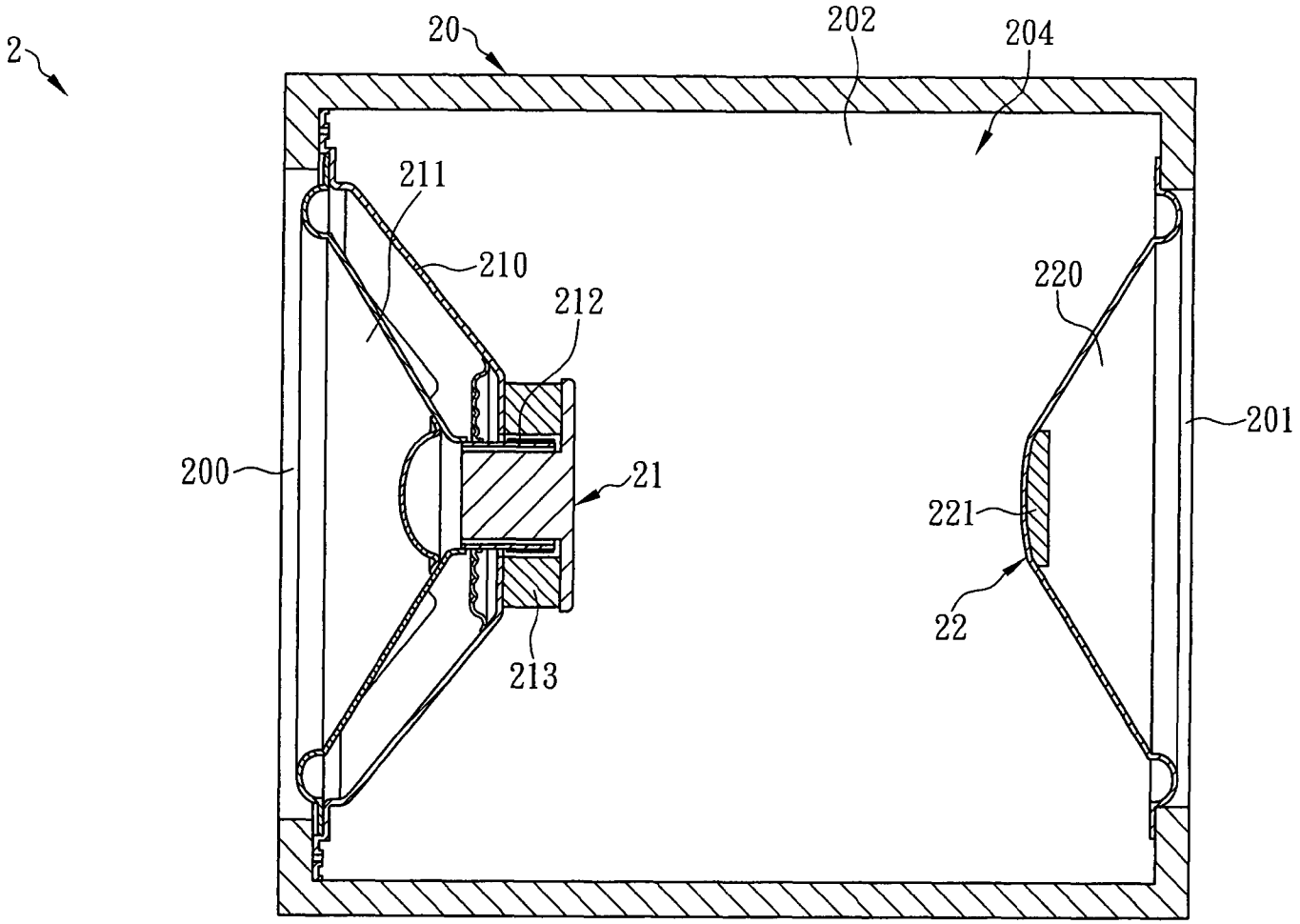
FIG. 2 is a sectional view of a first preferred embodiment of a sound reproduction device with enhanced low-frequency sound effect according to the present invention.
Figure 3:
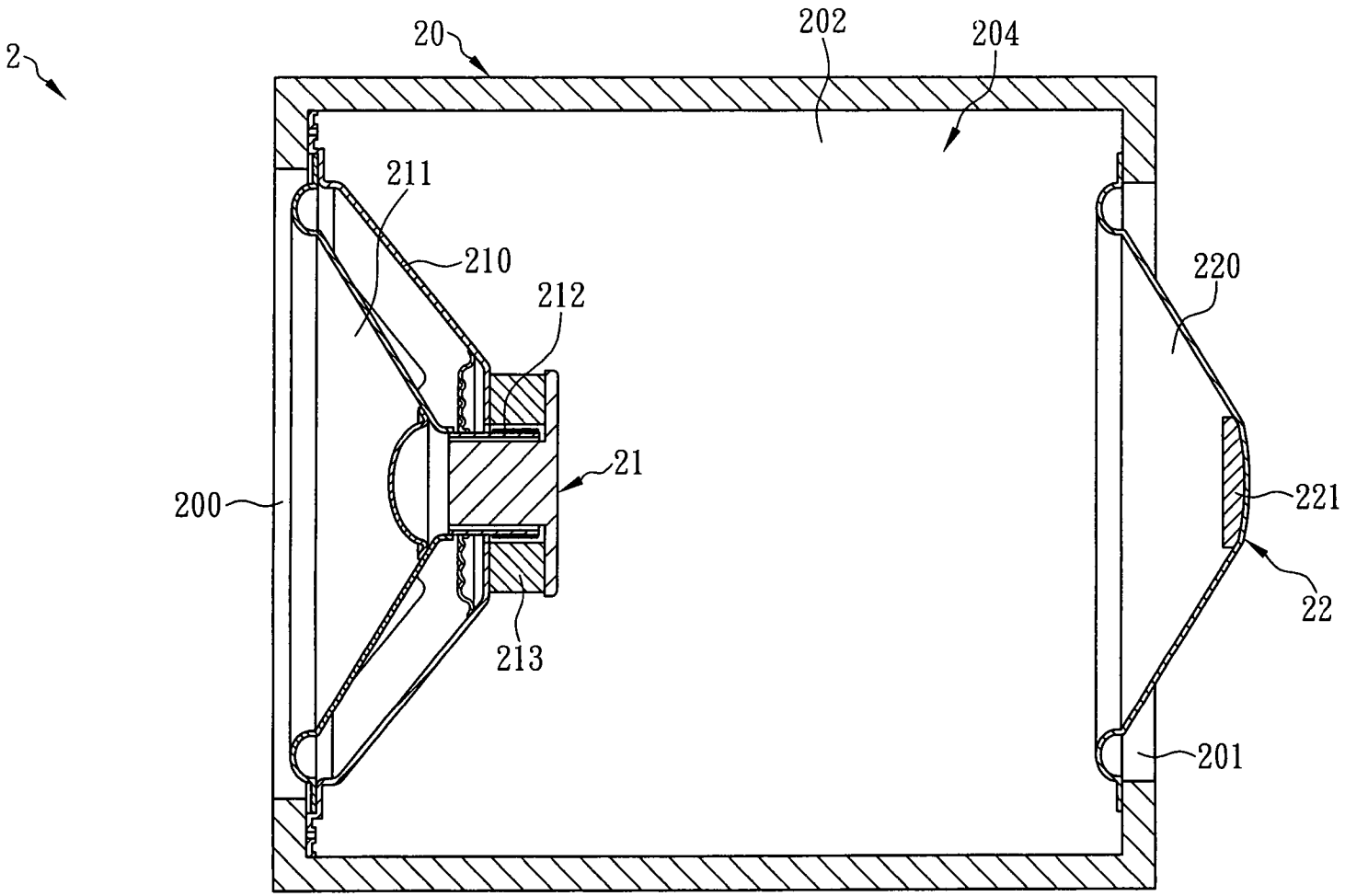
FIG. 3 is a sectional view of a second preferred embodiment of the sound reproduction device with enhanced low-frequency sound effect according to the present invention.

The present invention provides a sound reproduction device with enhanced low-frequency sound effect. Referring to FIG. 2, a sound reproduction device 2 according to a preferred embodiment of the present invention includes a tube 20, a loudspeaker 21, and a resonance unit 22. The tube 20 has two ends which are formed with a first opening 200 and a second opening 201, respectively. In addition, the tube 20 is provided therein with an accommodating space 204. The loudspeaker 21 includes a frame body 210, a first diaphragm 211, a coil 212, and a magnetic element 213. The first diaphragm 211 is attached to an inner periphery of a side of the frame body 210. The coil 212 is centrally provided at an inner periphery of the first diaphragm 211. The magnetic element 213 is provided at an inner periphery of an opposite side of the frame body 210 and mounted around a periphery of the coil 212. In the loudspeaker 21, the side of the frame body 210 that is adjacent to the first diaphragm 211 is peripherally fixed to the first opening 200 such that the frame body 210, together with the coil 212 and the magnetic element 213 provided in the frame body 210, is received in the accommodating space 204. The resonance unit 22 is composed of a second diaphragm 220 and a weighting element 221. The second diaphragm 220 is peripherally fixed to the second opening 201. As the first and second diaphragms 211, 220 seal the first opening 200 and the second opening 201, respectively, the accommodating space 204 in the tube 20 between the loudspeaker 21 and the resonance unit 22 becomes a closed resonance chamber 202. The weighting element 221 is fixed at a central position of an inner periphery of the second diaphragm 220. In the present preferred embodiment, the weighting element 221 is received in the accommodating space 204. However, in another preferred embodiment of the present invention, as shown in FIG. 3, the weighting element 221 is located outside the accommodating space 204. Furthermore, while the loudspeaker 21 in the preferred embodiment shown in FIG. 2 has the same structure as a commercially available traditional loudspeaker, the loudspeaker 21 is not limited to such a structure when the present invention is implemented. The loudspeaker 21 may have other configurations as long as the side of the frame body 210 that is adjacent to the first diaphragm 211 is peripherally fixed to the first opening 200 such that the accommodating space 204 between the first diaphragm 211 of the loudspeaker 21 and the second diaphragm 220 fixed to a rim of the second opening 201 forms the closed resonance chamber 202.

When the coil 212 is excited to generate field lines, the coil 212 is attracted and repelled by field lines generated by the magnetic element 213. Consequently, the first diaphragm 211 is driven to vibrate, and vibration of the first diaphragm 211 in turn vibrates air in front of the sound reproduction device 2 so as to make sound. Meanwhile, as the loudspeaker 21 and the resonance unit 22 are connected by the closed resonance chamber 202, vibration of the first diaphragm 211 produces a compression/vacuum effect on air inside the resonance chamber 202 and thereby drives the second diaphragm 220 of the resonance unit 22 to vibrate almost synchronously, wherein the synchronicity of vibration depends on the length of the tube 20, the material of the second diaphragm 220, and the weight of the weighting element 221. Thus, air behind the sound reproduction device 2 is vibrated by the second diaphragm 220 in the same direction. As a result, the air in front of and behind the sound reproduction device 2 is vibrated almost synchronously in the same direction, thereby producing twice as much low-frequency sound effect as a traditional sound reproduction device that does not have a resonance unit. Moreover, while the second diaphragm 220 is vibrated, the weighting element 221 on the second diaphragm 220 suppresses the vibration amplitude of the second diaphragm 220. Therefore, the second diaphragm 220 is effectively prevented from being damaged by an excessively large amplitude, and the second diaphragm 220 is vibrated almost synchronously with the first diaphragm 211 to double the low-frequency sound effect produced. Furthermore, as the sound reproduction device 2 relies on only one loudspeaker 21 to make sound at high volume and produce significant low-frequency sound effect, the sound reproduction device 2 is capable of effectively reducing power consumption, achieving the goal of energy saving and environmental protection, and allowing manufacturers to cut a considerable amount of design and production costs, thereby increasing market competitiveness of the sound reproduction device 2.

Figure 4:
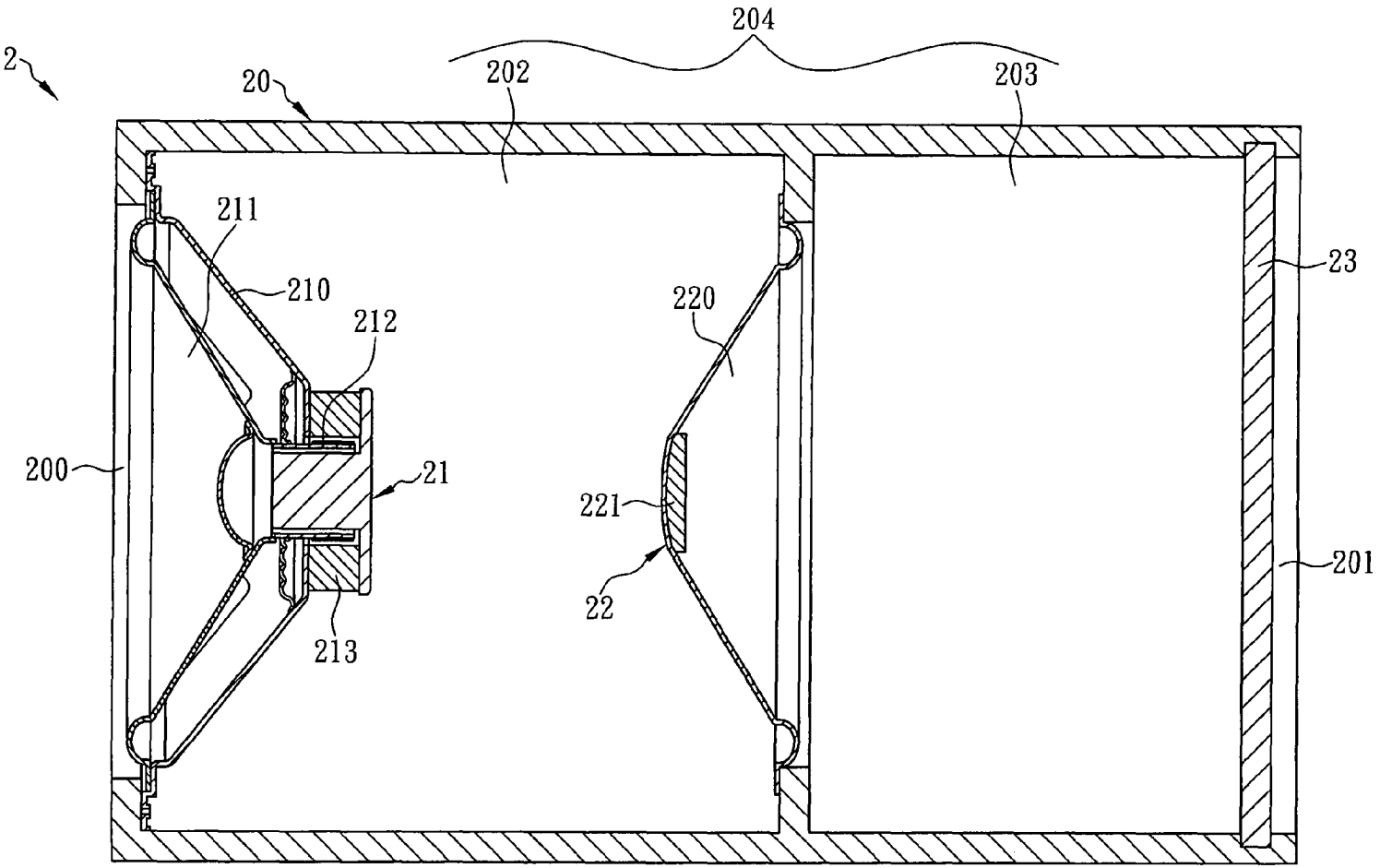
FIG. 4 is a sectional view of a third preferred embodiment of the sound reproduction device with enhanced low-frequency sound effect according to the present invention.
Figure 5:
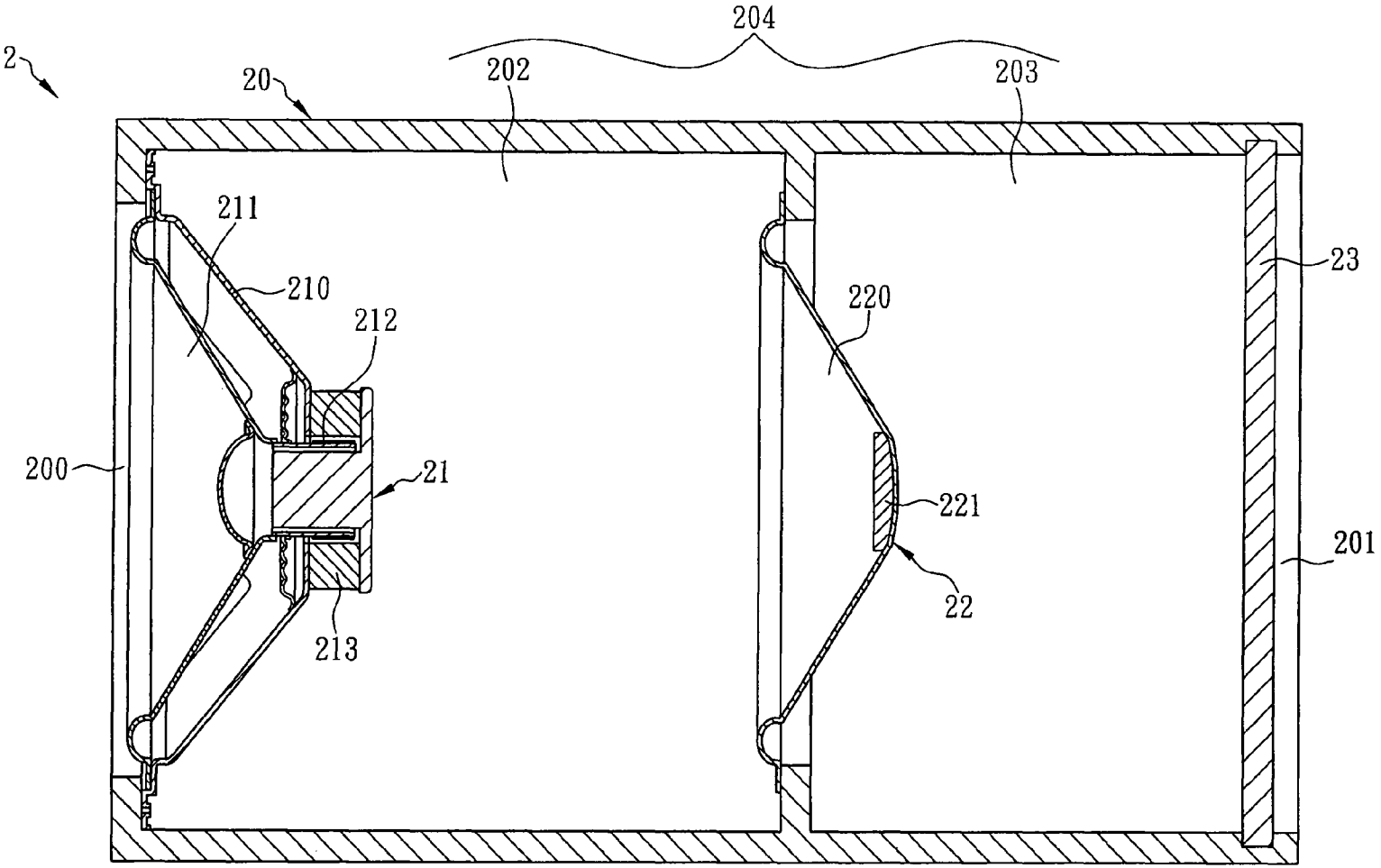
FIG. 5 is a sectional view of a fourth preferred embodiment of the sound reproduction device with enhanced low-frequency sound effect according to the present invention.

Please refer to FIG. 4 for another preferred embodiment of the present invention. A sound reproduction device 2 includes a tube 20, a loudspeaker 21, a resonance unit 22, and a plate 23. The tube 20 has two ends which are formed with a first opening 200 and a second opening 201, respectively. In addition, the tube 20 is provided therein with an accommodating space 204. The loudspeaker 21 includes a frame body 210, a first diaphragm 211, a coil 212, and a magnetic element 213. The first diaphragm 211 is attached to an inner periphery of a side of the frame body 210. The coil 212 is centrally provided at an inner periphery of the first diaphragm 211. The magnetic element 213 is provided at an inner periphery of an opposite side of the frame body 210 and mounted around a periphery of the coil 212. In the loudspeaker 21, the side of the frame body 210 that is adjacent to the first diaphragm 211 is peripherally fixed to the first opening 200 such that the frame body 210, together with the coil 212 and the magnetic element 213 provided in the frame body 210, is received in the accommodating space 204. The resonance unit 22 is composed of a second diaphragm 220 and a weighting element 221. The second diaphragm 220 is peripherally fixed to an inner periphery of the tube 20. Thus, by virtue of the first diaphragm 211 and the second diaphragm 220, a closed resonance chamber 202 is defined in the accommodating space 204 of the tube 20 as between the loudspeaker 21 and the resonance unit 22. The weighting element 221 is fixed at a central position of the second diaphragm 220 and, as shown in the present embodiment, is received in the resonance chamber 202. The plate 23 is peripherally fixed to the second opening 201 such that, by virtue of the second diaphragm 220 and the plate 23, a closed reflection chamber 203 is defined in the accommodating space 204 of the tube 20 as between the resonance unit 22 and the plate 23. In a different preferred embodiment of the present invention, as shown in FIG. 5, the weighting element 221 is received in the reflection chamber 203.

When the coil 212 is excited to generate field lines, the coil 212 is attracted and repelled by field lines generated by the magnetic element 213. Consequently, the first diaphragm 211 is driven to vibrate, and vibration of the first diaphragm 211 in turn vibrates air in front of the sound reproduction device 2 so as to make sound. Meanwhile, as the loudspeaker 21 and the resonance unit 22 are connected by the closed resonance chamber 202, vibration of the first diaphragm 211 produces a compression/vacuum effect on air inside the resonance chamber 202 and thereby drives the second diaphragm 220 of the resonance unit 22 to vibrate almost synchronously, wherein the synchronicity of vibration depends on the length of the tube 20, the material of the second diaphragm 220, and the weight of the weighting element 221. In consequence, air in the reflection chamber 203 is vibrated by the second diaphragm 220 in the same direction. Moreover, the air in the reflection chamber 203 is reflected by the plate 23 so as to cause secondary resonance, whose effect depends on the material of the plate 23 and the distance between the second diaphragm 220 and the plate 23. Because of the synchronous vibration and the secondary resonance, almost twice as much low-frequency sound effect is produced in front of and behind the sound reproduction device 2 as compared with a traditional sound reproduction device without a resonance unit. Therefore, even though there is only loudspeaker 21, the sound reproduction device 2 is well capable of making sound at high volume and providing significant low-frequency sound effect.

Figure 6:
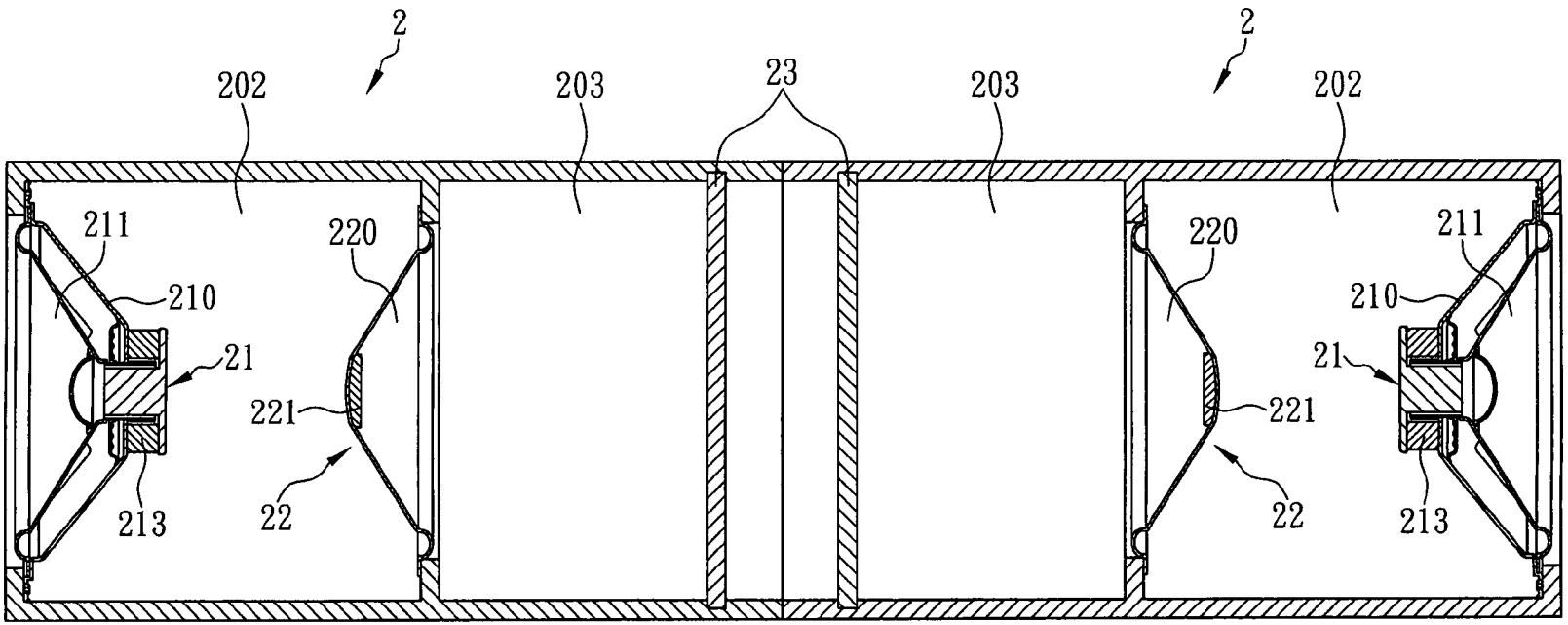
FIG. 6 is a sectional view of a fifth preferred embodiment of the sound reproduction device with enhanced low-frequency sound effect according to the present invention.

In yet another preferred embodiment of the present invention, as shown in FIG. 6, two sound reproduction devices 2 are connected back to back and operate in conjunction with each other so as to provide stereophonic reproduction for enriched sound quality. In addition, with plates 23 being provided where the sound reproduction devices 2 are joined, vibration of diaphragms 211, 220 in the sound reproduction devices 2 is effectively prevented from mutual interference. Hence, a user will not hear noise or echo which may otherwise result from interference between sounds reproduced respectively by the sound reproduction devices 2.

In short, referring again to FIG. 2, the sound reproduction device 2 of the present invention uses essentially the single loudspeaker 21 and the resonance unit 22 to effectively increase sound volume and low-frequency sound effect. Apart from that, the present invention also allows the costs of production, quality control, design, and materials to be effectively reduced while the goal of energy saving and environmental protection is attained. It should be noted that the foregoing embodiments are only the preferred embodiments of the present invention and are not intended to limit the structural features of the present invention. All changes or modifications which are easily conceivable by a person skilled in the art and do not depart from the spirit and scope of the present invention should be encompassed by the appended claims.

What is claimed is:

1. A sound reproduction device with enhanced low-frequency sound effect, comprising:

a tube having two ends formed respectively with a first opening and a second opening, the tube being provided therein with an accommodating space;

a loudspeaker comprising a frame body, the frame body having a side which is adjacent to a first diaphragm thereof and peripherally fixed to the first opening, such that the frame body together with a coil and a magnetic element provided in the frame body is received in the accommodating space, and the first diaphragm together with the frame body seals the first opening;

a resonance unit comprising a second diaphragm and a weighting element, the second diaphragm being peripherally fixed to an inner periphery of the tube, such that the second diaphragm seals the inner periphery of the tube, and a closed resonance chamber is defined in the accommodating space of the tube as between the loudspeaker and the resonance unit by the first diaphragm and the second diaphragm, wherein the weighting element is fixed at a central position of the second diaphragm; and a plate peripherally fixed to the second opening, such that the plate seals the second opening, and a closed reflection chamber is defined in the accommodating space of the tube as between the resonance unit and the plate by the second diaphragm and the plate.

2. The sound reproduction device with enhanced low-frequency sound effect as claimed in claim 1, wherein the weighting element is received in the resonance chamber.

3. The sound reproduction device with enhanced low-frequency sound effect as claimed in claim 1, wherein the weighting element is received in the reflection chamber.

* * * * *